US005413638A

United States Patent [19]

Bernstein, Jr. et al.

[11] Patent Number: 5,413,638

[45] Date of Patent: May 9, 1995

[54] APPARATUS FOR METALIZING INTERNAL SURFACES OF TUBULAR METAL BODIES

[76] Inventors: Philip Bernstein, Jr., 309 W. Fullerton Parkway Apt. 7 W., Chicago, Ill. 60614; James L. Schuppe, 5410 N. 41st St., Milwaukee, Wis. 53209

[21] Appl. No.: 934,037

[22] Filed: Aug. 21, 1992

Related U.S. Application Data

[63] Continuation-in-part of Ser. No. 592,357, Oct. 3, 1990, abandoned.

[51] Int. Cl.[6] ..... B05B 7/16; B05B 13/06

[52] U.S. Cl. ..... 118/620; 118/55; 118/308; 118/318; 118/DIG. 10; 198/747; 427/183; 427/233; 427/234

[58] Field of Search ..... 118/620, 55, 254, 308, 118/318, DIG. 10; 427/183, 231, 233, 234; 198/747

[56] References Cited

U.S. PATENT DOCUMENTS

| | | | |
|---|---|---|---|
| Re. 24,852 | 8/1960 | Armstrong et al. | 29/429 |
| 2,822,291 | 2/1958 | Hahn | 427/376.8 |
| 2,845,366 | 7/1958 | Schroeder | 427/376.8 |
| 3,007,810 | 11/1961 | Hobrock | 118/318 |
| 3,063,860 | 11/1962 | Gemmer | 427/182 |
| 3,158,499 | 11/1964 | Jenkin | 427/57 |
| 3,207,618 | 9/1965 | De Hart | 427/182 |
| 3,218,184 | 11/1965 | Lemelson | 427/182 |
| 3,245,824 | 4/1966 | Treat et al. | 118/308 |
| 3,359,943 | 12/1967 | Briggs et al. | 118/306 |
| 3,394,450 | 7/1968 | Gill et al. | 427/181 |
| 3,405,000 | 10/1968 | Jacobson | 427/182 |
| 3,526,027 | 9/1970 | Manuel et al. | 118/308 |
| 3,532,531 | 10/1970 | Stallard | 427/183 |
| 3,654,895 | 4/1972 | Bloom et al. | 118/725 |
| 3,814,616 | 6/1974 | Kondo et al. | 427/28 |
| 3,974,306 | 8/1976 | Inamura et al. | 427/181 |
| 3,982,050 | 9/1976 | Kato et al. | 427/182 |
| 4,071,641 | 1/1978 | Susai | 427/234 |
| 4,076,136 | 2/1978 | Jenkin | 414/433 |
| 4,122,798 | 10/1978 | Gibson | 118/50 |
| 4,169,906 | 10/1979 | Hallstrom et al. | 427/183 |
| 4,174,410 | 11/1979 | Smith | 427/57 |
| 4,197,336 | 4/1980 | Savchenko et al. | 427/234 |
| 4,243,699 | 1/1981 | Gibson | 427/183 |
| 4,302,482 | 11/1981 | Heck | 427/34 |
| 4,490,411 | 12/1984 | Feder | 427/34 |

*Primary Examiner*—Peter Chin
*Assistant Examiner*—Dean T. Nguyen

[57] ABSTRACT

Apparatus for internally coating a pipe, comprising a device for heating a pipe as it is internally spray coated and a plurality of inlet rollers and a plurality of outlet rollers for supporting the pipe while it is being heated and longitudinally advanced through the heating device. Each roller is spaced from and adjacent to a corresponding roller in a paired relationship to thereby define a nesting groove located above a gap between each set of paired rollers. A motive device rotates the rollers to rotate the pipe within the nesting grooves of adjacent pairs of rollers. An advancing device longitudinally advances the pipe through the heating device and sequentially along the nesting grooves of adjacent pairs of rollers. The pipe leaving the heating device is heated to a high temperature and has an increased diameter. The supporting surfaces of the rollers are positioned at different distances from the rotational axis of the pipe to retain and align the center line in the heated, expanded pipe sections with the center lines of the colder and smaller diameter pipe sections. This maintaining of the center line of the pipe aligned in a straight line, even at the expanded diameter sections, minimizes vibration of the pipe.

20 Claims, 6 Drawing Sheets

APPARATUS FOR METALIZING INTERNAL SURFACES OF TUBULAR METAL BODIES

This application is a continuation-in-part of patent application entitled Method and Apparatus for Metalizing Internal Surfaces of Metal Bodies such as Tubes and Pipes, Ser. No. 592,357, filed Oct. 3, 1990, now abandoned.

FIELD OF THE INVENTION

The present invention relates to the metalizing of the interior of tubular metal bodies, such as pipes and tubes. More particularly, the present invention relates to method and apparatus for metalizing the interior surface of tubular bodies to produce interiorly metalized articles, such as chrome plated pipes, tubes, and segments thereof. In particular, the present invention relates to the metalizing of interior surfaces of tubular products with corrosion resistant and abrasion resistant metals to provide for extended life for the tubular products in their environment of use.

BACKGROUND OF THE INVENTION

There are many fields of manufacture in which the interior of a base body, such as a pipe or tube, or a segment thereof, is metalized over an ordinary metal such as steel with an expensive surface layer treatment or coating that is fused to the base metal in order to provide a finished, or partly finished, part or product that will respond to manufacturing specifications, but which is less expensive than making the entire body of the same material that the coating specifications require. Thus, parts such as the interior of pipes or tubes used to convey corrosive or abrasive fluids, liquids, slurries and the like, are frequently required to provide thereon an interior metalized surface of chromium, or chrome, or other special metal or metal alloy, that will either resist corrosion and wear or will provide a good bearing surface. In strings of pipe used in deep oil wells, for example, it is desirable that the interior surface of the pipe have resistance to corrosion and wear, so as to extend the time period during which a string of pipe will function before corrosion or abrasive failure causes disruption of oil production and consequent increase of costs. Similarly, strings of pipe which are used to transport concrete slurry from a source of supply to the site of use, must have a wear resistant inner surface in order to withstand the abrasion of the inner surface which is caused by the aggregate (sand, gravel, and crushed stone) which is mixed with the cement in the concrete slurry.

It has been long known that ordinary steels, except for leaded steels or resulphurized steels, may be chrome surfaced by plating or the like, to meet the specifications for desired strength of the part and provide the surface character specially required for exposure to a harsh environment in which the part is to be used.

However, chromium, for example, is a relatively expensive material, and the use of chromium in various chemical baths by which chrome plating may be effected is environmentally undesirable, operationally difficult and expensive to control. Also, it is technically difficult to deposit a metalizing layer of any substantial thickness onto the interior surface of tubes or pipes, or segments thereof, that are to serve as the bearing surface of a bearing or journal element.

While metalizing the exterior surface of bars and rods avoids, to substantial extent, the undesirable environmental effects associated with chemical plating of such bodies, the mechanical metalizing techniques previously employed in metalizing such bars and rods have usually used an open flame torch that burns fuel gases, such as acetylene, propane, or the like in the presence of oxygen, to both preheat the body surface to an elevated temperature and to heat the surface application material, which is initially in powder form, to a temperature at which the powdered coating material will become at least partially molten and fuse onto the base material of the body. These prior art metalizing techniques have not been wholly successful for economically metalizing the exterior of tubes, since the heat of a torch will frequently burn through the wall of the tube. It will be understood that such prior art metalizing techniques also generally are not successful in metalizing the interior of elongated tubes and pipes, since access to the interior of such elongated bodies with an open flame torch is very difficult, if at all possible.

The problems with said prior technique for metalizing exterior surfaces are that there is both lack of accurate control of the thickness of the layer of the surface application material to the underlying body, and resultant lack of uniformity of the thickness of the layer that is applied by open torch heat. Furthermore, the minimum thickness of the layer of applied material usually obtained by metalizing with an open flame torch working with powdered metal is about 0.008 inch, and the maximum thickness of a layer of applied metal is about 0.015 inch, both of which thickness values are frequently much greater than the thickness of the applied material layer which is required to be supplied to meet the performance specifications for the metalized part, and this substantially increases the cost of manufacture.

A further problem is that when using fine particles of metalizing materials to form a fused surface on an underlying body, the torch heat intensity is frequently so great that it vaporizes or burns away a substantial quantity of the finest particles of the metalizing material, thereby resulting in loss of the coating material and economic waste. Still another problem is that, in the event a thick layer of metalizing is required to be deposited, there is insufficient control over the thickness of metal being deposited and, therefore, maintaining the concentricity of the inner surface of a metalized sleeve or journal is difficult, and machining or other expensive finishing operations must be resorted to in order to obtain a high degree of concentricity of the innermost surface of an arcuate part that has been metalized.

Other techniques are also available for metalizing with a vapor, either in an inert atmosphere or under vacuum. Such processes include chemical vapor deposition and physical vapor deposition, as by evaporation, ion plating, and sputtering. The products of these processes are coatings and free-standing shapes such as sheet, foil and tubing of thicknesses ranging from 20 nm to 25 mm. However, these processes do not lend themselves readily to the metalizing of the internal surface of long lengths of pipe or tubing.

An improved method of metalizing the interior of metal bodies is disclosed in U.S. Pat. No. 4,490,411, which discloses an apparatus and method for metalizing the interior of pipes or tubes using powdered metal. The base metal pipe or tube which is to be internally metalized is moved axially while simultaneously being rotated at a relatively high rpm. A first preheat means, preferably comprising an induction heater, heats a portion of the pipe and its interior to a first elevated temperature, and the particles of the metalizing powder are deposited into the interior of the pipe to be heated to the first elevated temperature. The rotation of the pipe distributes the fluidized particles into laminae which under further influence of centrifugal forces, automatically distributes the semi-fluidized particles effectively. The fluidized metalizing material is bonded together and to the body substrate by application of a second induction heat at a higher temperature at which the bonding then occurs between the laminae of the metalizing material and between the metalizing material and the base material of the tube or pipe. Preferably, the process is performed in the presence of a non-oxidizing gas such as preheated nitrogen, neon, or argon.

Two means are disclosed for delivering the metalizing powder to the interior of the pipe to be metalized. In one embodiment, the metalizing powder is conveyed to the interior of the pipe by means of a cantilevered boom or supply-support tube through which the metalizing powder, entrained in a stream which includes a pressurized non-oxidizing gas, is delivered in the form of a spray or shower from a nozzle in the interior of the pipe at a station located laterally or axially between the two electrical induction heating coil means, with the first such induction heating means being a preheater and the second induction heating means being the metalizing heater for accomplishing the metal fusion. In the second embodiment, an elongated auger tube and concentric auger are utilized for delivering metalizing powder to the desired point of discharge between the first induction coil and the second induction coil.

Although the method and apparatus embodiments of U.S. Pat. No. 4,490,411 are capable of producing internally metalized pipe of acceptable quality, the patent teaches a method and apparatus for supporting, rotating, and axially advancing the pipe which is being metalized where these three functions are all accomplished by a single mechanism. This mechanism comprises a set of angular pipe-rotating means which are shown in FIG. 1 of the patent adjacent the left hand of the drawing. The means include a pair of pipe engaging drive rollers 14 located on opposite sides of the pipe 10 which is being coated, and frictionally engaging the pipe 10 in part below the midheight of the pipe so that the roller engagement with the pipe also serves as a support. The rollers are driven by any convenient well known means, such as electrical motors 16, at a high speed, and selective speed control may be effected by techniques well known in the art. The direction of rotation of the angled drive rollers is indicated by the arrows 18 in FIG. 1 and they bring about the rotation of the pipe 10 and simultaneous axial movement of the pipe 10 as indicated generally by the spiral or helical arrow 20 which is shown associated with pipe 10 in FIG. 1. Because the rollers 14 are angularly oriented on the cylindrical surface of the pipe, they simultaneously rotate the pipe and axially advance the pipe through the heating zone.

It has been determined that this method and apparatus technique may create a potential problem, since the single unit is simultaneously rotating and pushing the pipe through the heating zone. Because the heating zone imposes sufficient heat to melt and fuse the powdered metal coating, the wall of the pipe 10 will approach a state of plasticity, so that the combination of rotation and axial advancement of the pipe by the single roller assembly can cause physical distortion and damage to the pipe at the zone of plasticity due to the simultaneous imposition of torsional and compressive forces applied by the angled roller assembly.

In order to avoid this potential problem, a coating apparatus has been fabricated and operated which comprises a plurality of first and second rotatable rollers for supporting a rotating pipe prior to its being heated. Each second roller is spaced from and adjacent to a corresponding first roller in a paired relationship to thereby define a gap of fixed dimension between each pair of adjacent first and second rollers. A heating means which is operable to melt and fuse the powdered metal coating to the inside surface of a rotating pipe is located downstream of these inlet rollers. At the hot side, which is downstream of the heating means, are a plurality of third and fourth sets of rollers for supporting the rotating pipe as it passes through the heating station. Each fourth roller is spaced from and adjacent to a corresponding third roller in a paired relationship to thereby define a gap of the fixed dimension between each pair of adjacent third and fourth rollers. A nesting groove is located above the gap between each pair of rotatable rollers and between the adjacent portion of the upper surfaces of each pair of rotatable rollers. A first motive means is utilized for rotating the first and second rollers to thereby rotate an elongated tubular body, such as a pipe or tube, within the nesting grooves of adjacent pairs of first and second rollers, and a second motive means is utilized for rotating the third and fourth rotatable rollers to thereby rotate an elongated tubular body within the nesting grooves of the adjacent pairs of the third and fourth rollers. A separate individual axial advancing means is used for longitudinally advancing a rotating elongated tubular body sequentially along the nesting grooves between adjacent pairs of first and second rollers, through the heating means, and sequentially along the nesting grooves between adjacent pairs of third and fourth rollers. Finally, the means for internally coating the elongated tubular body is a spray head which is located within the heating element for depositing the particulate coating material on the inside surface of the pipe.

While this modified apparatus has been successful in eliminating the problem which may be encountered by use of the angular rotational apparatus disclosed in U.S. Pat. No. 4,490,411 of distorting and damaging the rotating and axial advancing pipe in the heated region of plasticity, a new and different problem has been encountered with the modified apparatus. It has been found that as the heated rotating pipe is discharged from the heating means, there is an occasional problem which arises due to vibration of the hot pipe advancing along the sequence of nesting grooves between the third and fourth rollers on the discharge side of the heating unit. This vibration occasionally becomes so intense that the rotating hot pipe may eventually vibrate sufficiently to fly off of the array of third and fourth rollers and onto the floor. Occasionally, the vibrating pipe may touch the induction heating coil which is located within the heating means and short-out the heater, thereby causing premature shutdown of the entire operating unit.

Accordingly, it is an object of the present invention to provide a method and apparatus for internally coating the surfaces of elongated metal bodies such as tubes and pipes without encountering distortion and damage to the tube or pipe at the zone of highest temperature due to compressive and torsional forces which are imposed upon the pipe by an angled roller device used to simultaneously rotate and longitudinally advance the pipe through the heating apparatus.

It is also an object of the present invention to provide a method and apparatus for internally coating a metal tube or pipe without encountering excessive vibration of the tube or pipe as it is withdrawn from the heating apparatus and cooled while rotating and longitudinally advancing along the sequence of nesting grooves between the adjacent pairs of third and fourth rollers in the coating apparatus.

It is another object of the present invention to provide a method and apparatus for internally coating a metal pipe or tube without encountering vibration of the tube or pipe as it is withdrawn from the heating apparatus which is sufficient to cause the tube or pipe to be thrown out of the nesting grooves between the pairs of third and fourth rollers and onto the floor of the plant.

It is a further object of the present invention to provide a method and apparatus for internally coating a metal tube or pipe without vibration which is sufficient to cause the rotating and longitudinally advancing metal tube or pipe to touch the electrical elements of the heating unit and thereby cause a short circuit which shuts down the entire coating system.

These and other objects of the present invention, as well as the advantages thereof, will become more clear to those skilled in the art from the disclosure which follows.

SUMMARY OF THE INVENTION

The rotating pipe thermally expands in the heating apparatus with the largest diameter being at the location of highest temperature heating of the pipe metal. The rotating pipe expands rapidly in the heating apparatus to this largest diameter and thermally contracts in diameter as the maximum diameter portion travels from the heating apparatus. The rotating, thermally expanded section of pipe leaving the heating apparatus is continually contracting as it leaves the heating apparatus, and is moved to discharge from the coating apparatus.

It has now been found that the differences in diameter of the pipe from its largest diameter through to its smallest diameter should be accommodated by positioning the roller supporting surfaces at positions to maintain the center line, i.e., axis of the thermally expanded pipe, on a horizontal plane or line. In the prior art, the rollers were all positioned at the same height such that the larger diameter sections of the pipe were being forced upwardly and away causing the center line of the pipe to be forced out of the horizontal. Because the rollers were spaced in the axial advancing direction and all at the same height, each of the roller pairs was supporting a different diameter section of the rotating pipe. It has been determined that this failure to accommodate for different thermal diameter sections causes the axially advancing hot pipe to vibrate within the sequence of nesting grooves as it rotates, thereby causing the pipe to occasionally spin out of the nesting grooves and onto the floor, or to occasionally bounce against an electrical heating element and short-out the internal coating apparatus.

Therefore, the present invention provides method and apparatus concepts which compensate for the thermal expansion and contraction of the rotating pipe or tube as it is passed axially out of the heating apparatus and sequentially along the nesting grooves between adjacent pairs of outlet rollers, so that the rotating hot pipe or tube maintains its central axis horizontal without a substantial raising or lowering of a section of the pipe center line as the pipe advances sequentially along the nesting grooves of adjacent pairs of rollers.

Accordingly, the present invention provides a method and apparatus for coating the inside of a rotating pipe or tube which is being advanced axially in a direction parallel to its rotational axis, which is usually horizontal disposed, while being supported along its length by pairs of rollers with the pipe seated in a nesting gap between each pair of adjacent rollers. The pipe is moved along a horizontal path of travel, preferably by a pusher, while the supporting roller pairs are driven by a motor drive means to rotate the pipe resting on these supporting and driving rollers. In accordance with the invention, the rotating rollers are positioned, particularly on the downstream side of the heating apparatus, so that these rotating roller surfaces engage and support the thermally expanded section of pipe thereon with the portion of the pipe center line being aligned on a true horizontal plane and with each adjacent pipe center line portion of the horizontal pipe axis also being aligned. To accommodate the different diameters of the pipe on the rollers, the supporting rollers are adjusted to have their supporting surfaces at different heights with the roller height surfaces being progressively raised higher in the downstream direction as the diameter of the pipe decreases in the downstream direction. Various adjusting means or mechanisms may be used, several of which are described herein to compensate for the thermal contraction of the pipe.

In one preferred embodiment, the present invention comprehends a coating apparatus for coating the inside surface of an elongated tubular body which comprises the combination of machine elements defined in the preceding paragraph, and further including means for internally coating an elongated tubular body passing through the heating means. An adjusting means is positioned on the first and second rotatable shafts for adjusting a sequence of nesting grooves adjacent the inlet end and along an inlet portion of the first and second shafts to compensate for thermal expansion and thermal contraction of a rotating coated tubular body longitudinally advancing from the heating and coating means into sequential nesting grooves of adjacent pairs of first and second rollers so that the center line axis of the pipe remains substantially horizontal.

In a first embodiment, the adjusting means comprises a first sequence of first and second paired rollers adjacent the inlet end of the first and second shafts with the paired rollers in the first sequence having progressively increasing paired outer diameters, followed by a second sequence of first and second paired rollers having paired outer diameters of a constant dimension which is greater than the dimensions of the paired outer diameters of the first sequence. In a further aspect of this first embodiment, the coating apparatus is characterized by this adjusting means wherein the first sequence of first and second paired rollers is preceded by an initial sequence of first and second paired rollers having progressively decreasing paired outer diameters. More particularly, the paired rollers having the varying outer diameters may be removably mounted on the first and second shafts so that they are replaceable when a different size cylindrical body is being processed.

In a second embodiment, the adjusting means comprises at least one first deflection means on the first rotatable shaft proximate the inlet end for bowing the first rotatable shaft laterally away from the second rotatable shaft, and at least one second deflection means on the second rotatable shaft proximate the inlet end for bowing the second rotatable shaft laterally away from the first rotatable shaft. Preferably, a plurality of first deflection means are mounted proximate the inlet end of the first rotatable shaft and a plurality of second deflection means are mounted proximate the inlet end of the second rotatable shaft. Typically, the pluralities of first and second deflection means are positioned on the first and second shafts as adjacent spaced apart opposing pairs, and each opposing pair of first and second deflection means is activated by a single horizontal shaft deflection device. By adjusting the amount of side deflection of the two shafts, the expansion and contraction of the hot rotating pipe may be compensated for so that the center line axis of the pipe remains substantially horizontal.

In a third embodiment, the adjusting means comprises at least one first deflection means on the first rotatable shaft proximate the inlet end for bowing the first rotatable shaft downwardly from its undeflected axial position, and at least one second deflection means on the second rotatable shaft proximate the inlet end for bowing the second rotatable shaft downwardly from its undeflected axial position. Preferably, a plurality of first deflection means are mounted proximate the inlet end of the first rotatable shaft and a plurality of second deflection means are mounted proximate the inlet end of the second rotatable shaft. Typically, the pluralities of first and second deflection means are positioned on the first and second shafts as adjacent spaced apart matching pairs, and each matching pair of first and second deflection means is activated by a single vertical shaft deflection device. By adjusting the amount of vertical deflection of the two shafts, the expansion and contraction of the hot rotating pipe may be compensated for so that the center line axis of the pipe remains substantially horizontal.

In addition, the present invention comprehends an apparatus for imposing lateral deflection upon a pair of spaced apart rotatable shafts. Further, the present invention comprehends an apparatus for imposing parallel axial deflection upon a pair of spaced apart rotatable shafts, to deflect said shafts in a vertical direction.

Moreover, the present invention comprehends the methods which are involved in operating the various embodiments of the apparatus inventions.

A clearer understanding of the present invention will be obtained from the disclosure which follows when read in light of the accompanying drawings.

DESCRIPTION OF THE PREFERRED EMBODIMENTS

Figure 1:
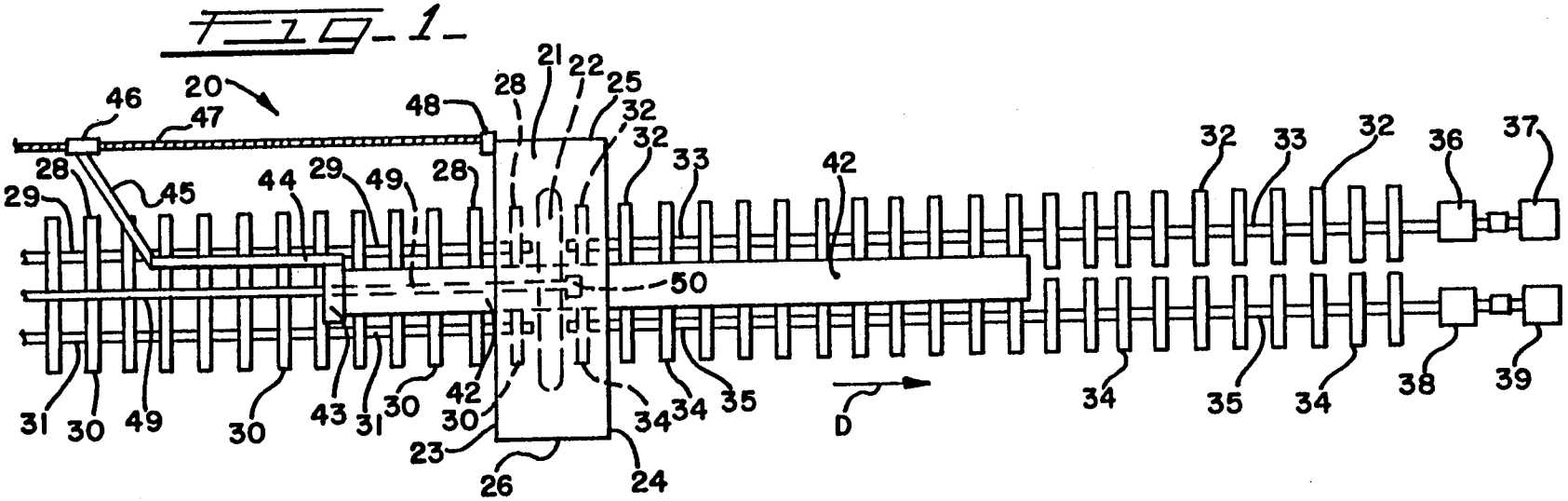
FIG. 1 is a simplified schematic representation, in plan view, of an apparatus for spray coating the interior surface of a rotating longitudinally advancing pipe or tube in accordance with the present invention.
Figure 2:
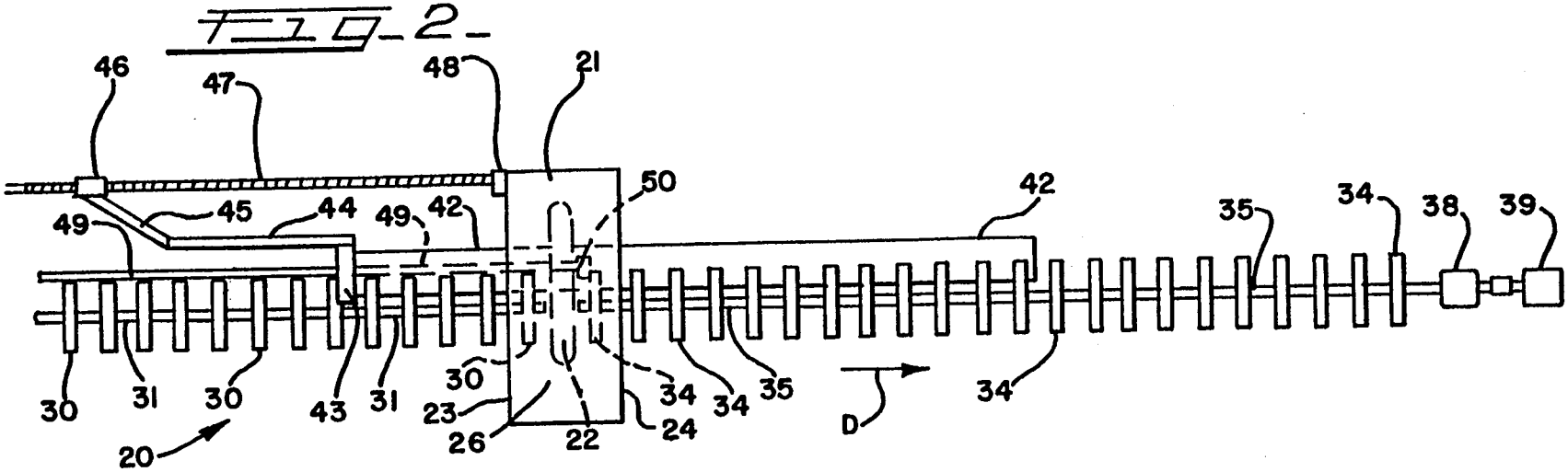
FIG. 2 is a simplified schematic representation of the apparatus of FIG. 1, presented in a left side elevational view.

Referring now to FIGS. 1 and 2, there is shown a metal coating apparatus 20 in accordance with the present invention. The apparatus 20 includes an induction heating device 21 which contains a generally circular induction coil 22 having one or more circular windings. The induction heating device has a housing which includes an inlet side 23, an outlet side 24, a right side 25, and a left side 26. On the inlet side of the induction heater device there is located a plurality of right inlet rollers 28 mounted on a rotatable right inlet roller shaft 29, and a plurality of left inlet rollers 30 mounted on a rotatable left inlet roller shaft 31. On the outlet side of the induction heating device 21 there is a plurality of right outlet rollers 32 mounted on a rotatable right outlet roller shaft 33, and a plurality of left outlet rollers 34 mounted on a rotatable left outlet roller shaft 35.

At the far end of the rotatable shaft 33 is a right outlet roller variable speed transmission 36 which is coupled to shaft 33 on one side and to a right outlet roller electrical drive motor 37 on the other side. At the far end of the left outlet roller shaft 35 is a left outlet roller variable speed transmission device 38 which is coupled to shaft 35 on one side and to a left outlet roller electrical drive motor 39 on the other side. In an alternate embodiment, not shown, the variable speed transmission devices 36 and 38 may be eliminated by providing that the right outlet roller electrical drive motor 37 and the left outlet roller electrical drive motor 39 are each coupled directly to the outlet roller shafts 33 and 35, respectively, in which case both drive motors are variable speed motors. Equivalent motive means are coupled at the inlet ends of inlet roller shafts 29 and 31, but they are not shown in the drawings since they are to the far left of FIGS. 1 and 2. In any event, all motive means are operatively coupled to conventional control means which rotate the roller drive shafts 29, 31, 33 and 35 in unison in a manner sufficient to provide that a rotating elongated tubular body passing from the first and second inlet rollers 28 and 30 and through the heater 21 will continue to rotate at the same speed and in the same direction as it enters upon the outlet rollers 32 and 34.

It will be recognized that FIGS. 1 and 2 are simplified schematic representations of the apparatus configuration. Various standard elements of the machine, such as the machine frame with supporting brackets, pedestals, bearings, thrust bearings, and the like have been omitted from FIGS. 1 and 2 for purposes of clarity. Similar omissions are made in FIGS. 3 through 19 for the same purpose.

Figure 3:
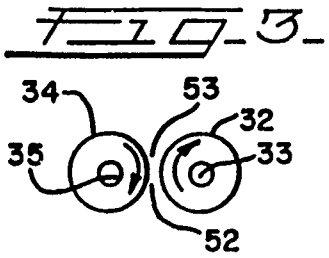
FIG. 3 is a simplified schematic representation, shown as an end view, of a pair of rotating rollers on the outlet side of the apparatus of FIGS. 1 and 2.
Figure 4:
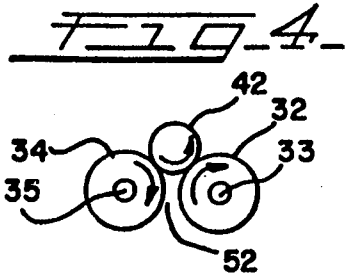
FIG. 4 is a simplified schematic representation of the paired outlet rollers of FIG. 3, but showing a pipe or tube rotating within the nesting groove between the rotating paired outlet rollers.

FIGS. 1 and 2 show a cylindrical tube or pipe 42 which is rotating within the nesting grooves between the rotating paired rollers in the bed of the plurality of rollers hereinabove described. This can be more readily understood by referring now to FIGS. 3 and 4. In FIG. 3 there is shown an opposing pair of rotating outlet rollers 32 and 34, which are rotating upon their rotatable shafts 33 and 35, respectively. The opposing outlet rollers 32 and 34 are spaced apart to provide a gap 52 between the right outlet roller 32 and the left outlet roller 34. Above the gap 52 is a nesting groove 53 for the pipe 42, which can be positioned within the nesting groove 53 upon the rotating adjacent upper surfaces of the outlet rollers 32 and 34, as more clearly seen in FIG. 4. The pipe 42 has a longitudinal center line or axis 41 about which the pipe wall is concentric and about which axis the pipe rotates. While the pipe axis 42 could be displaced from a horizontal plane, the axis 41 is preferably horizontal and will be referred to as a horizontal center line or axis in this application.

As the cylindrical tube or pipe 42 is rotated within the nesting grooves 53 of the array of rollers, it is also advanced longitudinally within the sequence of nesting grooves between the paired rollers by means of a pusher unit, as shown by the directional arrow D in FIGS. 1 and 2. The pusher unit includes a pusher pad 43 which is held against the rear end of the pipe or tube 42. The pusher pad has an annular configuration, and it is attached to an elongated forearm 44, which in turn is attached to an angled upper arm 45, which terminates in a shoulder element 46. Shoulder element 46 contains a bore which has a helical inside thread in mating relationship with a helical screw thread on a reversibly rotatable drive shaft 47. The helical screw drive shaft 47 is driven by a motive means, not shown, which is attached to the end of the drive shaft 47 to the far left of FIGS. 1 and 2. The right end of the helical screw drive shaft 47 terminates in an end mount 48 which includes a thrust bearing.

A powdered metal feed line 49 extends above the plurality of rotating right inlet rollers 28 and left inlet rollers 30 and over the plurality of nesting grooves therebetween. Feed line 49 passes through a central opening in the annular pusher pad 43, and it enters the trailing end of the longitudinally moving pipe or tube 42. The powdered metal feed line 49 conveys a suspension of powdered metal in a non-oxidizing gas, such as nitrogen, helium, or argon, and it is supplied from a conventional source which is not shown since it is to the far left in FIGS. 1 and 2. The powdered metal suspension is sprayed onto the inside surface of the rotating pipe or tube 42 by means of a spray nozzle 50 located within the induction heating apparatus 21. It will be noted that as the pipe 42 advances longitudinally in the sequence of nesting grooves between the array of inlet rollers, it passes over and encompasses the feed line 49 and spray nozzle 50. As it moves through the induction heating coil 22, thermal excitation of the pipe metal and the sprayed powdered coating metal occurs, so that the powdered metal sprayed on the inside surface of the pipe 42 becomes melted, evenly distributed on the inner surface of pipe 42 by the rotation of the pipe 42, and then fused to the inside surface of the pipe 42 in a uniform thin layer.

Figure 6:
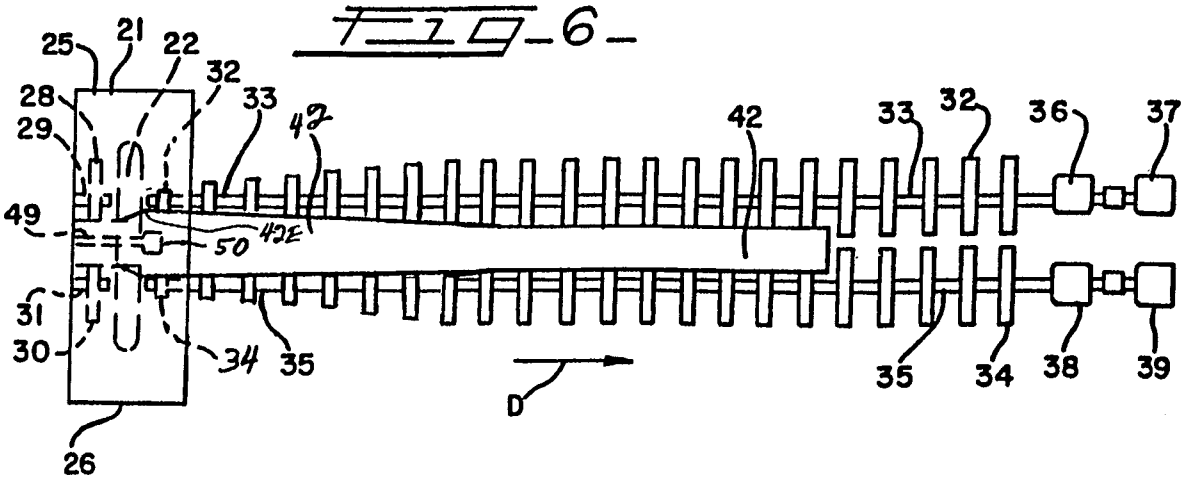
FIG. 6 is a simplified schematic plan view in accordance with FIG. 1, showing the outlet portion of the apparatus with a thermally expanded pipe or tube rotating within the nesting grooves between the rotating paired outlet rollers.
Figure 7:
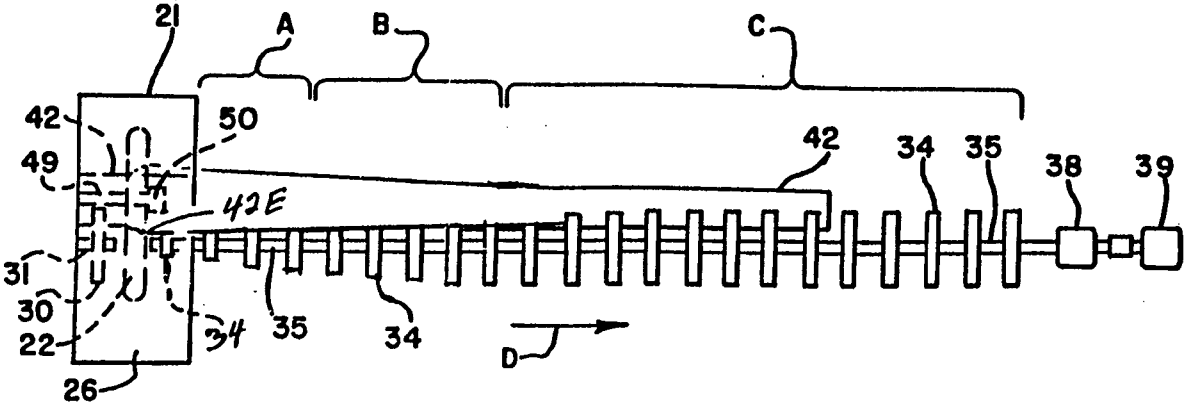
FIG. 7 is a simplified schematic left side elevational view in accordance with FIG. 2, showing the outlet portion of the apparatus with a thermally expanded pipe or tube rotating within the nesting grooves between the rotating paired outlet rollers.
Figure 5:
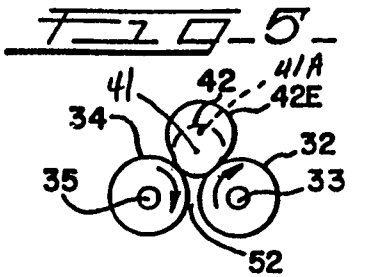
FIG. 5 is a simplified schematic representation of the paired outlet rollers of FIG. 4, but showing the maximum circumferential size of the pipe or tube due to thermal expansion as it rotates within the nesting groove between the rotating paired outlet rollers.

FIGS. 5, 6 and 7 illustrate the problem which is encountered in the apparatus of FIGS. 1 and 2, where the array of rollers is rotating the pipe or tube 42 as it is advanced longitudinally along the sequence of nesting grooves 53. Assuming a typical carbon steel pipe 42, and further assuming that the powdered metal which is sprayed from nozzle 50 within the induction heater 21 is a chrome alloy for imparting corrosion resistance to the inside surface of the pipe 42, the induction heating coil 22 will impose upon the carbon steel pipe 42 a temperature in the range of from about 1950° F. to 2300° F., or even more. This elevated temperature is necessary in order to cause the chrome alloy to melt and spread evenly along the inside surface of the rotating pipe 42 as it is moved longitudinally over the stationary spray head 50. Due to the sudden elevation of temperature from ambient to the elevated temperature, the pipe 42 experiences rapid thermal expansion. As the non-heated section of the pipe 42 enters the induction heating coil 22 the temperature of the pipe is continually raised to a maximum temperature at which will be the greatest thermal expansion and the largest pipe diameter.

This may be seen schematically in FIG. 5 where a pair of opposed right and left outlet rollers 32 and 34 are shown rotating with the conventional gap distance 52 between the rollers. The pipe 42, represented schematically by the dotted circular line, has its axis 41 at a predetermined position usually in a horizontal plane until the pipe 42 is heated. When the pipe is heated to the maximum circumferential dimension 42E, the axis 41A of this maximum diameter section will be raised to the location 41A above the axis 41 if no compensation is made to the rollers supporting this maximum diameter. Since the pipe is confined within the fixed geometric space of the nesting groove 53, it is constrained from expansion at the bottom position and it will expand outwardly at those portions of the pipe circumference which are above the rotating outlet rollers 32 and 34. This causes the pipe axis 41A to raise as the pipe assumes its maximum circumference, as shown by 42E.

Referring now to FIG. 6, there is shown the induction heater device 21 with the pipe 42 passing therethrough. As the pipe 42 enters the heater device 21, rapid thermal expansion occurs until the maximum circumferential dimension 42E is reached. At this point, the pipe has bowed outwardly to the sides as shown in FIG. 6. Outside of the heater housing and past the point of maximum circumferential dimension 42E, the pipe begins to cool rapidly because the ambient air acts as a cooling medium. Eventually the pipe 42 will reach a point where it is substantially at its original diameter.

This is more effectively discussed in reference to FIG. 7, which is a simplified schematic side elevational view of the apparatus disclosed in FIG. 6. It will be seen that the bottom of the pipe 42 is constrained by the nesting grooves 53 between the rollers 32 and 34. The center line or axis 41 of the pipe 42 in FIG. 7 is shown as a straight line. The pipe exiting from the induction heater 21 and leaving the heating zone, first enters a Zone A of rapid thermal contraction from the maximum expanded circumference 42E. The pipe 42 then passes through a Zone B of less rapid contraction where the circumference approaches, but does not truly reach, the original circumference of the pipe 42. The pipe then passes through Zone C, which is a zone of slower cooling where the final contraction of the pipe to its original circumferential dimension occurs.

If, as in the prior art, all of the supporting roller surfaces are at the same height, there is no accommodation made for the substantial differences in diameter of the pipe leaving the heater housing at the discharge end of the rollers 32 and 34. In the prior art, the roller surfaces pushed the plastic pipe section as it left the heater housing upwardly, because of the large diameter of the pipe, and raised the horizontal centerline 41 of this pipe section in Zone A relative to the colder and lowered horizontal axis of the colder pipe section at the right hand discharge rollers 32 and 34, as seen in FIGS. 6 and 7. Because of this difference in heights of the axis in Zones A, B and C on the supporting rollers, the pipe tended to vibrate within the nesting grooves as it rotated and moved along the rotating outlet rollers toward the end of the roller array. This vibration could reach a considerable degree of amplitude so that the pipe may be thrown over the side of the array of outlet rollers and onto the factory floor. Additionally, the vibration may reach such an amplitude that the portion of the pipe within the induction heating device 21 may touch the induction heater coil 22, thereby causing a short circuit and a shutdown of the coating apparatus.

The dimensions which are involved in this expansion and contraction of the pipe will be discussed hereinafter.

Figures 8, 9, 10, 11, 12, 13:
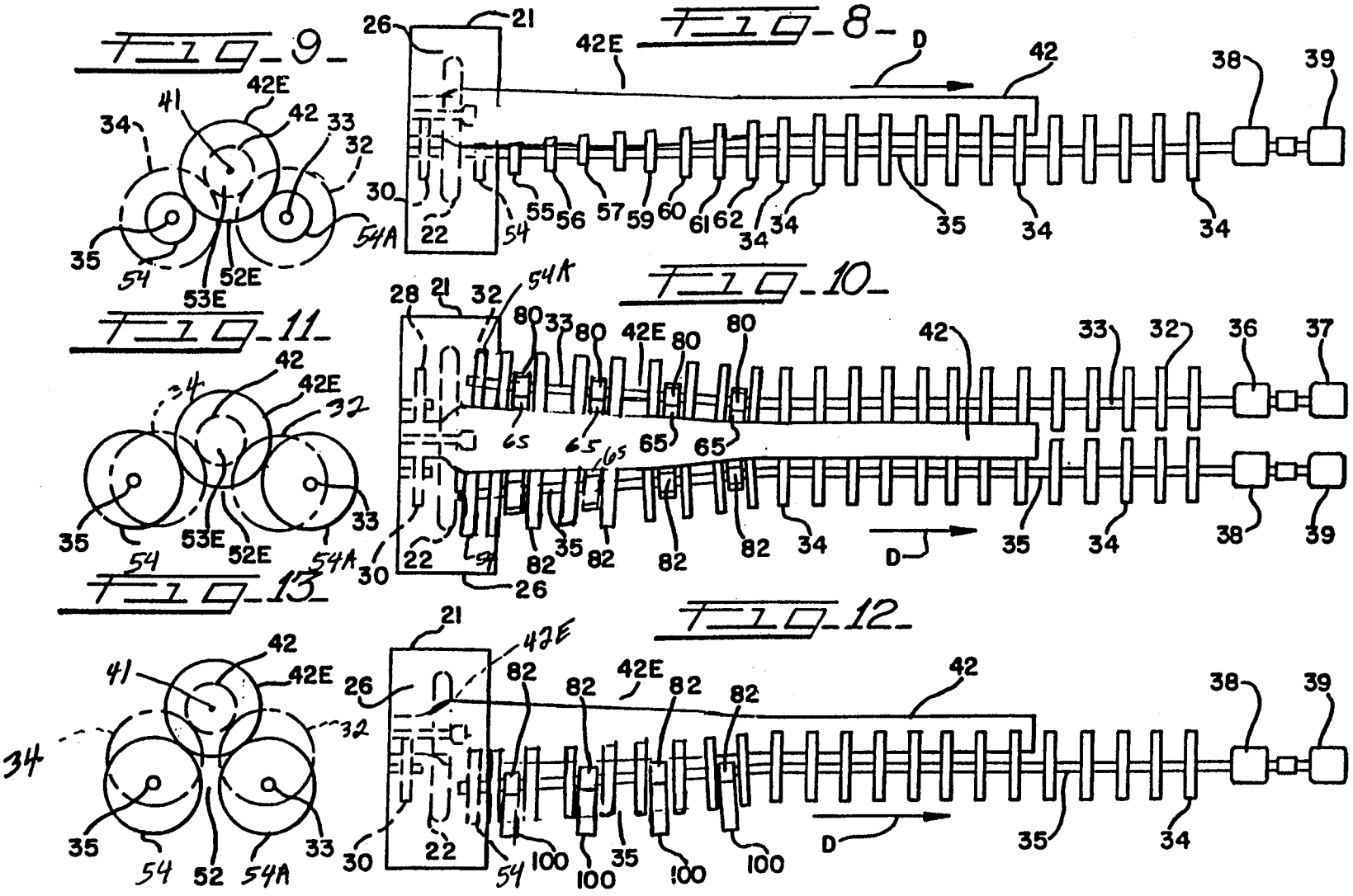
FIG. 8 is a simplified schematic left side elevational view in accordance with FIG. 2, showing the outlet portion of the apparatus with a thermally expanded pipe or tube rotating within the nesting grooves between rotating paired outlet rollers, where the outer diameters of the rotating paired outlet rollers are varied in order to compensate for the thermal expansion and contraction of the rotating pipe or tube.
FIG. 9 is a simplified schematic representation of a pair of rotating rollers on the outlet side of the apparatus of FIG. 8, showing rotating paired outlet rollers having a minimum outside diameter, with the rotating pipe or tube supported within the nesting groove at the point of maximum circumferential expansion of the pipe or tube.
FIG. 10 is a simplified schematic plan view in accordance with FIG. 1, showing the outlet portion of the apparatus with a thermally expanded pipe or tube rotating within the nesting grooves between the rotating paired outlet rollers, where the rotating outlet roller shafts have been bowed laterally in order to compensate for the thermal expansion and contraction of the rotating pipe or tube within the nesting grooves.
FIG. 11 is a simplified schematic representation of a pair of rotating outlet rollers at the point of the maximum circumferential expansion of the pipe or tube illustrating the lateral displacement of the rotating outlet roller shafts.
FIG. 12 is a simplified schematic left side elevational view in accordance with FIG. 2, showing the outlet portion of the apparatus with a thermally expanded pipe or tube rotating within the nesting grooves between the rotating paired outlet rollers, but showing the rotatable shaft for the outlet rollers deflected downwardly in order to compensate for the thermal expansion and contraction of the rotating pipe or tube within the nesting grooves.
FIG. 13 is a simplified schematic representation showing a pair of rotating outlet rollers on the outlet side of the apparatus of FIG. 12, showing the rotatable shafts deflected downwardly at the point of the maximum circumferential size of the pipe or tube due to thermal expansion as it rotates within the nesting groove between the downwardly deflected rotating outlet rollers.

One solution for eliminating the foregoing vibration problem is shown in FIGS. 8 and 9, where varying diameter rollers are illustrated. FIG. 8 is a simplified schematic side elevational view showing the induction heating apparatus 21 and the array of outlet rollers. It will be seen that as the pipe 42 exits from the induction heating device 21 and begins to contract, it rides upon rotating outlet rollers of increasing outer diameters in the downstream direction. This is illustrated by the roller 54 which has the smallest diameter and is located within the induction heating device 21. Next to roller 54 is increased diameter roller 55 which has a diameter smaller than that of the next roller 56. The smallest diameter roller supports the greatest diameter 42E of the pipe, and the roller 54 has a diameter which is less than that of all of the rollers 55, 56, and 57.

That is, the smallest roller 54 is generally at the location of the maximum thermal expansion as illustrated by the maximum circumference 42E. As the heated pipe passes from the induction heating device 21, the space for the nesting groove between the opposing outlet rollers, as represented by the phantom circles 32 and 34 in FIG. 9, becomes smaller and smaller since the diameters of the succeeding rollers 55, 56, and 57 are continually increasing. The original dimension of the pipe 42 is shown by the dotted circle 42 in FIG. 9, whereas the solid circle 42E illustrates the circumference at the maximum expansion. It will be noted that the axis of the pipe at the points of the maximum circumferential expansion 42E and at the point of maximum contraction are coincident and co-axial with the axis 41 of the original diameter of the pipe 42. Thus, by appropriate selection of the diameters of the sets of paired rollers throughout the regions of pipe expansion and contraction, the portions of the pipe 42 which are rapidly expanding and contracting are caused to remain concentric and aligned on the original longitudinal axis 41 of the pipe 42.

Referring again to FIG. 8, it will be seen that as the hot pipe 42 passes through the Zone B region of rapid cooling and contraction, the outer diameters of the rollers continue to increase. Thus, roller 58 has a diameter greater than roller 57, roller 59 has a diameter greater than roller 58, roller 60 has a diameter greater than roller 59, roller 61 has a diameter greater than roller 60, and roller 62 has a diameter greater than roller 61. Finally, the outer diameter of the outlet rollers is returned to its original dimension as seen at the roller 34 adjacent the roller 62. At this point, the pipe 42 is still hot and it has a residual amount of expansion, but the size differential due to expansion is not sufficient to cause the pipe to vibrate within the nesting grooves between the rollers.

This solution to the pipe vibration problem, entailing the use of outlet rollers having variable outer diameters, is most effectively used when the coating apparatus is used in a dedicated operation where a single finished product is continually produced. In operations where the apparatus operating conditions must be changed due to periodic changes in the type of finished product being manufactured, it is necessary to have a coating apparatus design wherein the variable diameter output rollers are replaceable rollers. This may be done by replacing the individual sets of paired rollers on the shafts 33 and 35 with sets of rollers having the required new outer diameters. Alternatively, this may be done by using a plurality of paired sets of output roller shafts 33 and 35, with each paired set of roller shafts having varying diameter output rollers permanently mounted thereon for use in production of a specific finished product. In this case, the rollers are changed by replacing the existing shafts and mounted rollers with the appropriate set of paired shafts having the proper size varying diameter rollers permanently mounted thereon. It will be recognized that shutdown of the coating apparatus 20 to replace the output rollers is time consuming, labor intensive and costly.

Accordingly, a second solution for eliminating the vibration problem hereinabove defined is illustrated in FIGS. 10 and 11, where the output roller shafts 33 and 35 are shown bowed apart sideways. FIG. 10 shows a simplified schematic plan view of the induction heating device 21 and the array of outlet rollers. As seen in FIG. 10, the pipe 42 contracts rapidly as it exits from the heating device 21 within which it reached the maximum circumference 42E. The pipe contracts as it leaves the heating device until it approaches the normal outer diameter for the pipe 42. The problem of pipe diameter change due to thermal contraction is compensated for in the apparatus of FIG. 10 by flexing the rotating shafts 33 and 35 laterally away from each other and from the center line or longitudinal axis of the pipe 42 in the zone of substantial expansion. This causes the gap to decrease between adjacent outlet rollers 32 and 34, which all have the same diameter, by a decreasing dimension in the zone of rapid contraction. This bowing of the shafts 33 and 35 outwardly from the pipe axis also thereby causes a decrease in the size and shape of the nesting grooves. Similarly, the shafts 33 and 35 are bowed outwardly by a decreasing dimension in the region of lesser pipe contraction so that the contracting pipe continues to rotate by riding on the upper portion of the rotating surfaces of rollers 32 and 34 within the contracting nesting grooves. Thus, the pipe will not vibrate as it passes longitudinally through the region of maximum expansion and contraction, since the pipe axis 41 remains horizontal throughout its travel its travel while the pipe is supported on each pair of rollers.

The flexing of the shafts 33 and 35 away from and then back toward the central axis of the pipe 42 is accomplished by a plurality of pillow blocks 80 and 82 which rotatably grip the shafts 33 and 35 in a paired relationship. The paired pillow blocks 80 and 82 are caused to deflect the rotating shafts 33 and 35 laterally for a selected distance by means of a plurality of horizontal shaft deflection devices 65, with each set of paired pillow blocks being operatively adjustable by a given deflection device 65. The horizontal shaft deflection devices 65, which are shown in FIG. 10, will be more completely described hereinafter in relation to FIGS. 14 and 15.

Referring now to FIG. 11, there is shown the sideway deflection of the right side rotating shaft 33 and the left side rotating shaft 35 of the rotating outlet rollers 32 and 34, respectively. It can be seen that the gap between the side deflected rollers 54 and 54A has been expanded to a dimension 52E at the point of maximum pipe circumference 42E. This dimension 52E is substantially the same as the dimension 52E which is shown in FIG. 9, where the compensation for the growth and contraction of the hot pipe 42 was made by using rollers having diameters of variable dimension. FIG. 11 also illustrates how the expanded hot pipe fits within the expanded nesting groove 53E, as shown by the maximum pipe circumference 42E. Expanded nesting groove 53E is also the same size and shape as that shown in FIG. 9. The expansion of the nesting groove to the size and shape 53E allows the expanded pipe circumference 42E to retain its position with its axis coincident with the horizontal axis of the pipe incoming to the heating unit. Thus, by appropriate selection of the distance of shaft deflection at each deflection device 65, the portions of the pipe 42 which are rapidly expanding and contracting are caused to remain concentric with the original longitudinal axis of the pipe 42 throughout the regions of rapid pipe expansion and contraction.

A third solution for eliminating the vibration problem hereinabove disclosed will be found in FIGS. 12 and 13, where the output roller shaft 35 is shown downwardly bowed. FIG. 12 shows a simplified schematic side view of the induction heater device 21 and the array of outlet rollers. In this embodiment, the shafts 33 and 35 of the outlet rollers are deflected vertically instead of laterally. This deflection of rotating shaft 35 is seen to be caused by the pillow blocks 82, shown in FIG. 12, which are mounted upon a plurality of vertical shaft deflection devices 100. Each deflection device 100 also operates a paired pillow block 80 for equivalent deflection of the rotating shaft 33, but the paired pillow blocks 80 and shaft 33 do not appear in FIG. 12 since they are directly behind the elements shown. The amount of deflection in a downward direction is varied by each individual vertical deflection device 100 in order to compensate for the amount of expansion or contraction that exists in the hot pipe 42 at that specific location.

FIG. 13 illustrates the downward deflection of the outlet rollers. It will be seen that the outlet rollers 54 and 54A have been displaced downwardly from their original position, which is illustrated by the phantom circles. Since the upper rotating surfaces of the rotating rollers 54 and 54A have been shifted downwardly, this allows the pipe 42, which is illustrated by the dotted circle, to expand uniformly radially as it rotates upon the upper surfaces of the rotating rollers 54 and 54A within the nesting groove. In this embodiment, the nesting groove has not increased in size or shape, nor has the gap 52 between the rotating rollers been increased in dimension. The vertical shifting of the rollers downwardly provides compensation so that the hot expanding pipe can achieve its maximum circumferential dimension 42E while remaining concentric with the longitudinal axis 41 of the original pipe dimension 42. By appropriate adjustment of the amount of deflection of the shafts 33 and 35 at each deflection device 100, the portions of pipe 42 which are rapidly expanding and contracting are caused to remain concentric with the original longitudinal axis 41 of the pipe 42 throughout the regions of rapid pipe expansion and contraction.

Figures 14, 15, 18, 19:
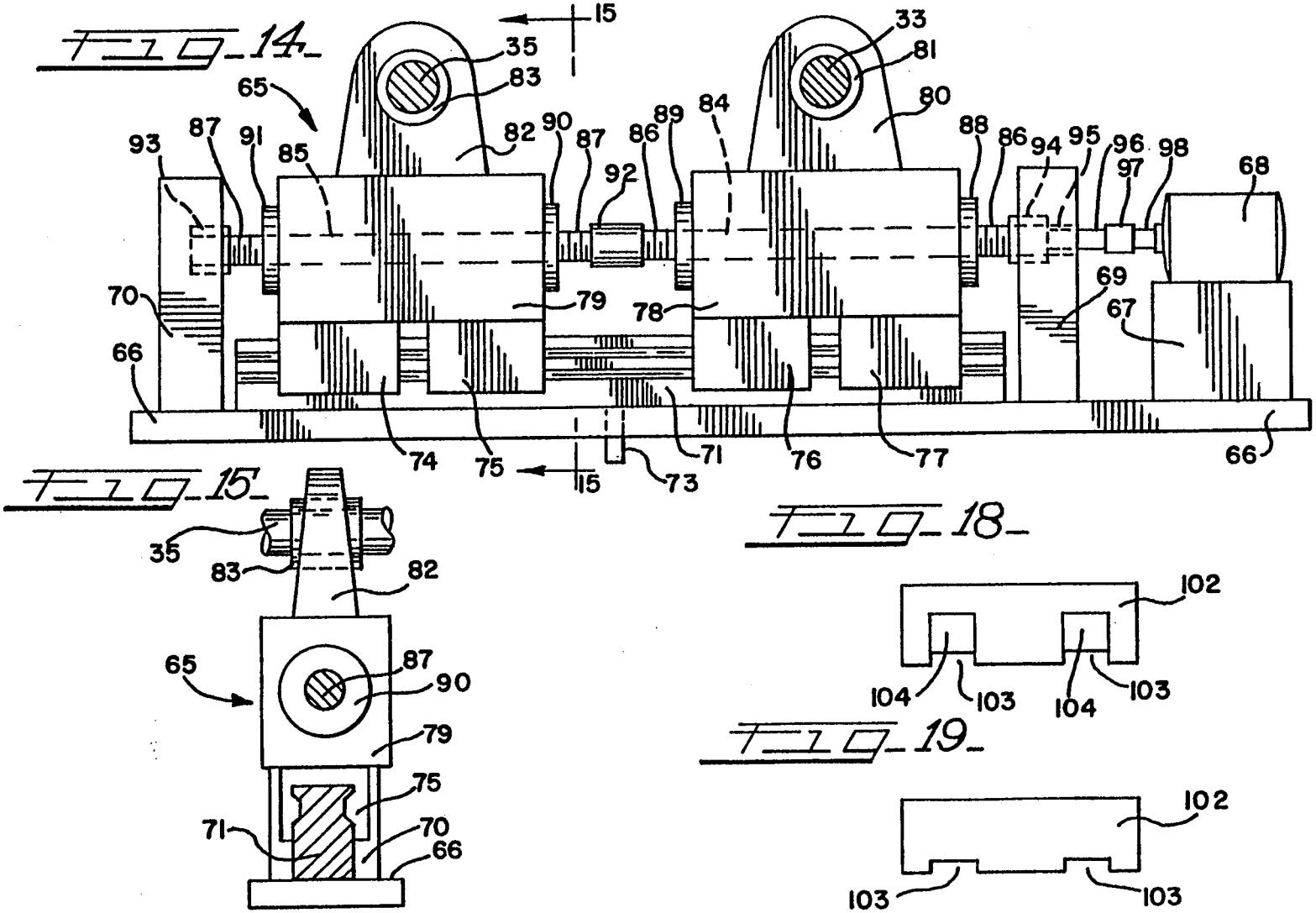
FIG. 14 is a simplified schematic representation, shown as a front elevational view, of a horizontal shaft deflection apparatus in accordance with the present invention.
FIG. 15 is a simplified schematic representation, shown as a left side elevational cross-sectional view, of the horizontal shaft deflection apparatus of FIG. 14 taken along section line 15—15.
FIG. 18 is a right side elevational view of the pillow block support plate of the apparatus of FIGS. 16 and 17.
FIG. 19 is a left side elevational view of the pillow block support plate of the apparatus of FIGS. 16 and 17.

Referring now to FIGS. 14 and 15, there is shown one embodiment of a horizontal shaft deflection apparatus 65 which may be used for deflecting the outlet roller shafts 33 and 35 to the side, as shown in FIGS. 10 and 11. FIG. 14 is a simplified schematic front elevational view of the apparatus, and FIG. 15 is a simplified schematic sectional view taken along section line 15—15 of FIG. 14. As seen in the Figures, the horizontal shaft deflection apparatus 65 has a base plate 66 upon which there is positioned a motor support pedestal 67. A reversible variable speed electrical motor 68 is mounted on the top of the motor support pedestal 67. A right bearing end support 69 is also mounted on the base plate 66, as is a left bearing end support 70 at the extreme left end of the base plate. In addition, the upper surface of the base plate 66 supports a bearing track 71. In the center of the base plate and extending downwardly therefrom, is a dowel pin 73 which is used for locating the deflection apparatus 65 on the frame of the bed of rollers 32 and 34 in the structure of the metal coating apparatus which has been illustrated in the foregoing FIGS. 1–13. Mounted upon the bearing track 71 are bearing trucks 74, 75, 76, and 77 which slide upon the bearing track 71. The mating configuration of the bearing track 71 with the bearing trucks can be seen more clearly in the cross-sectional view of FIG. 15, where it can be seen that the bearing track 71 has two recesses which are filled by two mating projections of the bearing truck 75.

Referring again to FIG. 14, it can be seen that the bearing trucks 74 and 75 support a left pillow block 79 and the bearing trucks 76 and 77 support a right pillow block 78. On the top surface of the right pillow block support 78 is a right pillow block 80 containing a bearing 81 which rotatably encompasses the right outlet roller shaft 33. Mounted upon the upper surface of the left pillow block support 79 is a left pillow block 82 containing a left pillow block bearing 83 which rotatably encompasses the left outlet roller shaft 35.

The right pillow block support 78 contains a horizontal bore 84 which has a smooth sidewall, and the left pillow block support 79 contains a hollow bore 85 which also has a smooth sidewall. A screw shaft 86 having a left hand thread passes through the smooth horizontal bore 84 of the right pillow block support 78, and a screw shaft 87 having a right hand thread passes through the smooth horizontal bore of the left pillow block support 79. Screw flanges 88 and 89 are mounted on the right and left end faces of the right pillow block support 78. These screw flanges are attached to the pillow block support 78 by means of conventional screws or bolts which are not shown. The screw flanges 88 and 89 contain an inner helical thread which mates with the left hand thread of the screw shaft 86. Similarly, screw flanges 90 and 91 are positioned on the end faces of the left pillow block support 79, and they also are attached with standard bolts or screws which are not shown. The screw flanges 90 and 91 have an internal right hand thread which mates with the right hand thread of the screw shaft 87. The helical screw shafts 86 and 87 are coupled together by a rigid coupling 92 in the center of the horizontal shaft deflection apparatus 65.

The left end of the right hand screw shaft 87 is mounted in a left end thrust bearing 93 which is contained within the left bearing end support 70. In a similar manner, the right end of the left hand screw shaft 86 passes through a thrust bearing 94 which is mounted within the right bearing end support 69. The right end of the left hand threaded screw shaft 86 terminates in a stepped-down stub shaft 96 which has a smooth surface. This shaft 96 rotates within a cast bronze sleeve bearing 95 which is also contained within the right bearing end support 69. The stepped-down smooth surface stub shaft 96 on the end of the helical screw shaft 86 is coupled to the motor shaft 98 of the motor 68 by means of a shaft coupling 97.

As previously disclosed, the motor 68 is a reversible variable speed electric motor, helical screw shaft 86 has a left hand thread, and helical screw shaft 87 has a right hand thread. Accordingly, when the motor turns screw shaft 86 clockwise, the pillow blocks 80 and 82 will come together, thereby shifting the rotating shafts 33 and 35 of the rotating outlet rollers 32 and 34, not shown, inwardly to thereby narrow the roller gap 52, not shown, and similarly narrow the nesting groove 53, not shown. Alternatively, when the motor 68 turns the screw shaft 86 counterclockwise, the pillow blocks 80 and 82 are moved apart, thereby shifting the rotating shafts 33 and 35 laterally apart to increase the gap 52 between the rotating rollers and increase the dimension of the nesting groove 53.

While the embodiments illustrated herein have all of the rollers attached to and driven by its associated drive shaft, in another embodiment of the invention, the first four rollers on the hot side nearest the heating means are not driven but are allowed to idler rollers. These idler rollers are mounted in the same manner as the remaining rollers which are mounted on and driven by their supporting shafts. The four idler rollers rotate on stub axles mounted in support stands. These third and fourth rollers of the idler sets of rollers can be shifted toward or away from each other by the operation of an adjusting means 65 similar to that shown and described in connection with FIGS. 14 and 15. That is, the respective pillow blocks 80 and 82 supporting the stub axles and their respective rollers have left and right handed screw threads which may be turned to slide the pillow blocks to increase or decrease the gap 52 between rotating third and fourth rollers.

Also, rather than having a single long shaft, it is preferred to have four short shafts each carrying five rollers thereon. The four short shafts are coaxially aligned and connected with flexible couplings to turn as a single shaft when driven by a motor at the end of the shaft. The ends of each of these four shafts are mounted in pillow blocks which are adjustable by the adjusting means 65 described in connection with FIGS. 14 and 15. Thus, there are five pillow block adjusting devices for shifting these four shafts to shift the position of the respective rollers thereon, which are supporting and rotating the pipe.

Figure 16:
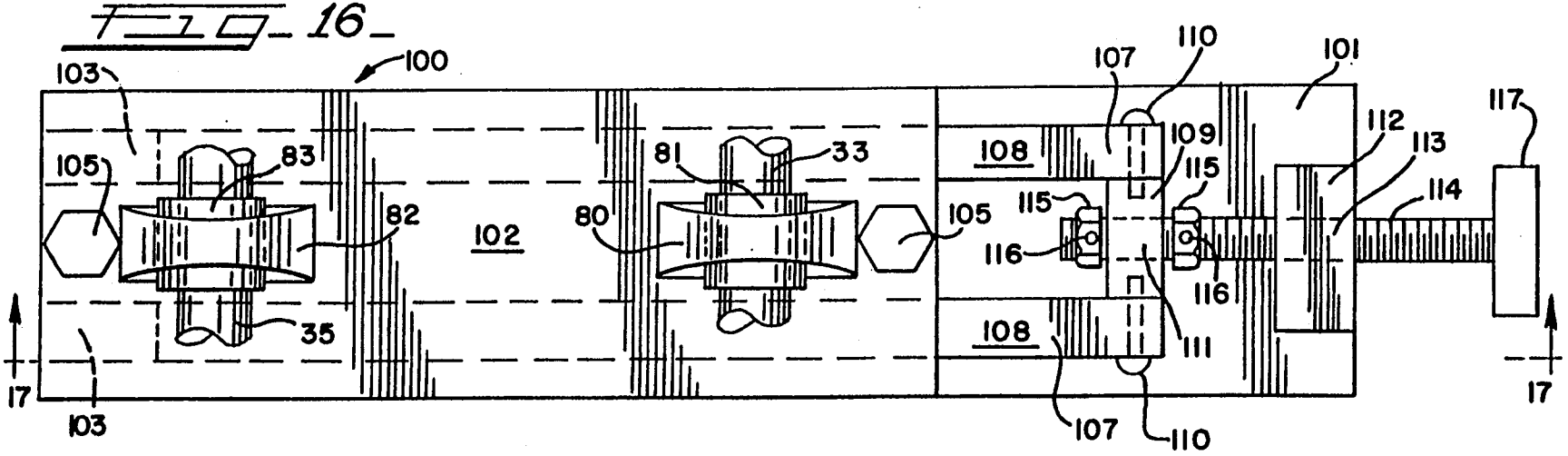
FIG. 16 is a simplified schematic representation, shown in plan view, of a vertical shaft deflection apparatus in accordance with the present invention.
Figure 17:
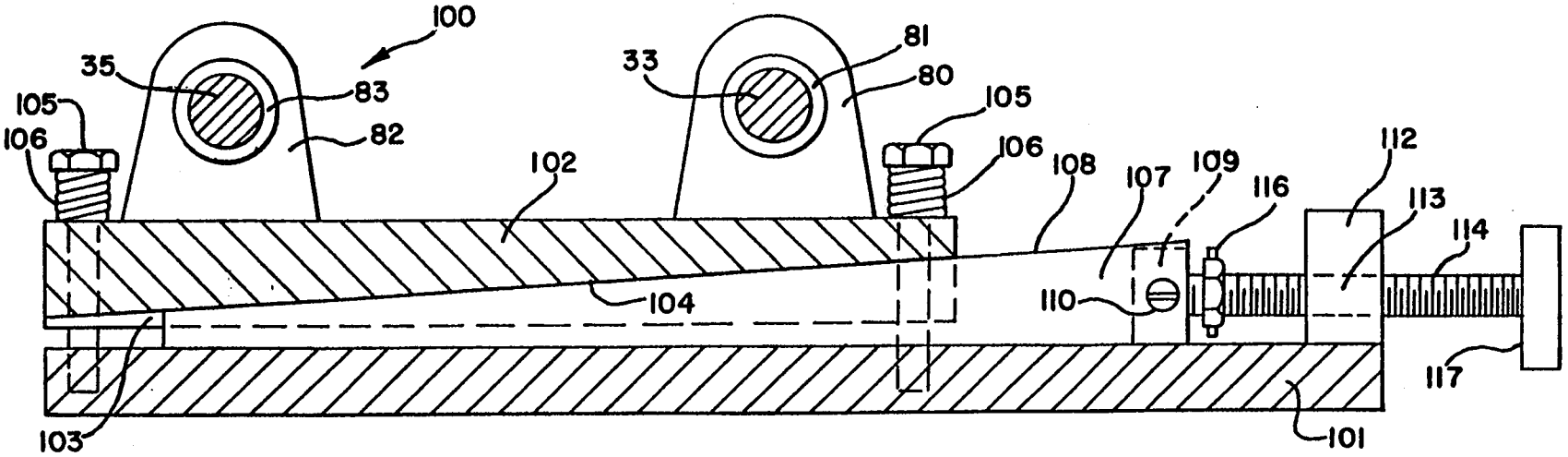
FIG. 17 is a front elevational cross-sectional view of the vertical shaft deflection apparatus of FIG. 16 taken along the section line 17—17.

Referring now to FIGS. 16 and 17, there is shown one embodiment of a vertical shaft deflecting apparatus 100 which was previously disclosed schematically in FIG. 12. The vertical shaft deflection apparatus 100 has a base plate 101 and a pillow block support plate 102. It will be seen that the pillow blocks 80 and 82 are positioned upon the top surface of the pillow block support plate 102. As previously disclosed, the pillow blocks 80 and 82 contain bearings 81 and 83, respectively, which confine the rotating outlet roller shafts 33 and 35, respectively. The pillow block support plate 102 contains a pair of ramped or inclined grooves 103. These inclined grooves are shown at the left end of FIGS. 16 and 17, but they are presented most clearly in FIGS. 18 and 19. FIG. 18 is an end view showing the right end of the pillow block support plate 102, and FIG. 19 is an end view showing the left end of the pillow block support plate 102. As seen in FIGS. 18 and 19, the pillow block support plate contains ramped or inclined grooves 103 which are cut into the bottom surface. The grooves contain inclined groove surfaces or faces 104 which are seen most clearly in FIGS. 17 and 18.

The pillow block support plate 102 is attached to the base plate 101 by means of shoulder bolts 105 which are located at the right and left ends of the pillow block support plate upper surface. This is seen most clearly in FIG. 17. Between the upper surface of the pillow block support plate 102 and the hexagonal head of the shoulder bolts 105 are die springs 106, which are heavy duty coil springs held in compression between the hexagonal head of each shoulder bolt 105 and the top of the pillow block support plate 102 at each location.

Between the base plate 101 and the pillow block support plate 102 are a pair of wedge-shaped blades 107 which are contained within the grooves 103 of the pillow block support plate. The blades 107 each have an inclined upper surface 108 in mating engagement with a corresponding inclined groove surface 104 of the pillow block support plate 102. This is best seen in FIG. 17. The two wedge-shaped blades 107 which are contained within the ramped or inclined grooves 103 of the pillow block support plate are attached together by a blade support yoke 109 at the right end of the base plate 101. The wedge-shaped blades 107 are attached to the blade support yoke 109 by means of blade attachment screws 110 which are seen in both FIGS. 16 and 17. The center of the blade support yoke 109 contains a central bore 111 which has a smooth sidewall. At the right end of the base plate 101 is an upstanding screw block 112 which contains a central bore 113 having a screw thread in the sidewall. A screw shaft 114 passes through the central bore 113 of the upstanding screw block 112 in a mating engagement with the screw thread in the sidewall of the central bore 113. The screw shaft 114 also passes through the central bore 111 of the blade support yoke 109. Mounted on the screw shaft 114 at its left end portion are a pair of lock nuts 115 which are locked onto the screw shaft 114 by means of locking pins 116. These locking nuts 115 allow the screw shaft 114 to be held within the central bore 111 of the blade support yoke 109 in a loose fit so that the shaft 114 may turn freely within the bore 111. On the outer end of the screw shaft 114 is mounted a turning means 117 which may be a manual knob, wheel, crank or the like. Alternatively, the turning means 117 may be a reversible variable speed electric motor.

It will be appreciated that as the turning means 117 rotates the screw shaft 114 in one direction, the blades 107 will be pushed further into the grooves 103 of the pillow block support plate 102. This causes the pillow block support blade to rise upwardly, thereby further compressing the die springs 106. On the other hand, if the screw shaft 114 is rotated in a reversed direction, the two wedge-shaped blades 107 will be partially withdrawn from the grooves 103. This then causes the compressed die springs 106 to forcibly push the pillow block support plate 102 downwardly, keeping the inclined groove surface 104 of the grooves 103 in tight engagement with the inclined upper surfaces 108 of the wedge-shaped blades 107. Thus, the rotating shafts 33 and 35 of the rotating outlet rollers 32 and 34, respectively, may be adjusted upwardly and downwardly in order to set the amount of vertical displacement which the shafts will have from the original position as illustrated in FIGS. 12 and 13.

It is to be realized that in the FIGS. 5–13, the amount of expansion and contraction of the tubular pipe tube 42 has been greatly exaggerated for purposes of illustration and clarity. That is to say, the pipe circumference 42E at the point of maximum expansion, the length of the Zone A of rapid contraction, and the length of the Zone B of contraction have been exaggerated in the Figures in order to enhance the ease of understanding of the inventions. Similarly, the variation in the roller diameters in FIG. 8 has also been exaggerated for purposes of illustration and clarity. Additionally, the amount of deflection of the rotating shafts 33 and 35 in FIGS. 10–13 has been exaggerated for purposes of illustration and clarity.

The amount of deflection of the outlet roller shafts 33 and 35, as well as the amount of variation in roller diameters, which is needed in order to compensate for the expansion and contraction of a hot pipe 42 is a small dimension, since the actual expansion and contraction is dimensionally small. However, compensation for such small dimensions is critical in eliminating the vibration problem which has been described hereinabove.

In point of fact, the maximum amount of growth in the diameter of the hot pipe will generally be only in the range of from about 0.200 to about 0.300 inch for nominal pipe sizes of from about 2 to 15 inches for carbon steel pipe. Yet, this small growth in pipe diameter can cause the vibration problem. Thus, for example, when the shafts 33 and 35 are deflected for this range of pipe sizes, the maximum required movement of each shaft is generally only about 0.100 to about 0.150 inch. Thus, whether the deflection is lateral or vertically downward, each shaft is shifted only from about 0.100 to about 0.150 inch away from its original center line position at the point of maximum circumferential expansion of the pipe 42.

The actual amount of expansion and contraction of the hot pipe will depend upon a number of parameters. Among the parameters which will influence the expansion and contraction of the metal pipe are the size of the metal pipe, its wall thickness, the composition of the metal pipe, the composition of the powdered coating being fused to the inside surface of the metal pipe, the speed of rotation of the pipe (rpm), the speed or rate of travel of the metal pipe longitudinally along the sequence of nesting grooves, heater temperature, room temperature, etc. The length of the expansion Zone A, the length of the contraction Zone B, and the length of the slow cooling Zone C, will also vary as these parameters are varied.

Figure 20:
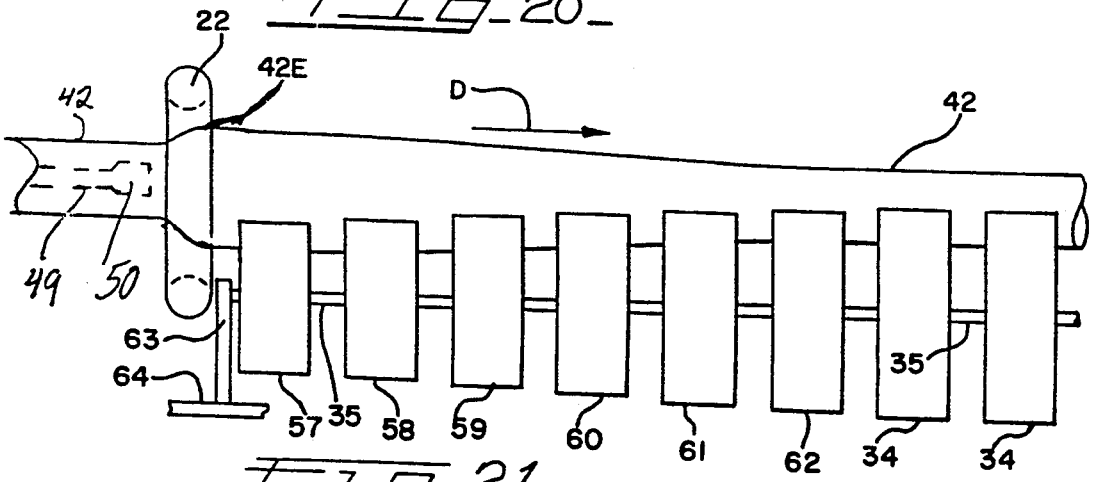
FIG. 20 is a simplified schematic left side elevational view, similar to that of FIG. 8, showing the outlet portion of the apparatus with a thermally expanded pipe or tube rotating within the nesting grooves between rotating paired outlet rollers, where the outer diameters of the rotating paired outlet rollers are progressively increased in diameter in order to compensate for the thermal contraction of the rotating pipe or tube.
Figure 21:
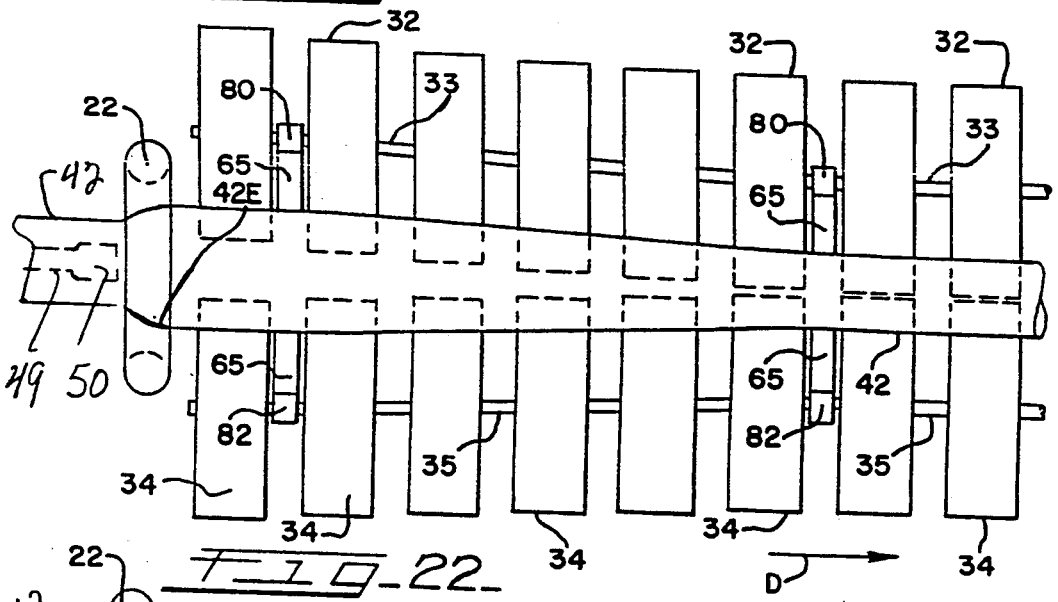
FIG. 21 is a simplified schematic plan view, similar to that of FIG. 10, showing the outlet portion of the apparatus with a thermally expanded pipe or tube rotating within the nesting grooves between the rotating paired outlet rollers, where the rotating outlet roller shafts have been bowed laterally in order to compensate for the thermal contraction of the rotating pipe or tube within the nesting grooves.

FIGS. 20–21 are simplified schematic representations showing apparatus configurations for dealing with the type of thermal expansion and contraction which is more typically encountered in the thermal processing of a carbon steel pipe using an induction heater of high power input, such as 200 kilowatts, in a commercial coating operation. In these figures it will be noted that the coating material feed line 49 terminates in the spray nozzle 50 on the input side of the induction coil 22. This is the preferred location for the spray nozzle 50 in the coating apparatus. Additionally, the output rollers 32 and 34 have a surface width of six inches and they are spaced from adjacent rollers three or four inches in the region of high thermal contraction of the carbon steel pipe.

These FIGS. 20–21 show the carbon steel pipe 42 increasing in diameter in the 200 kW induction heating coil to the largest diameter 42E. This means that the region of rapid thermal expansion occurs before the expanded pipe enters the nesting groove between the first pair of adjacent rotating output rollers 57.

Referring now to FIG. 20, there is shown a left side elevation view like FIG. 8, showing the induction heating coil 22 with the pipe 42 passing therethrough. The first sequence of the paired outlet rollers 57, 58 and 59 having increasing outer diameters. The expanded maximum circumference 42E is reached before the heated pipe advances upon the first set of paired rollers 57 having outer diameters of the minimum dimension. Thereafter, the pipe 42 advances through the nesting grooves of paired rollers having the increasing outer diameters as shown by the succeeding sequential pairs of rollers 58, 59, 60, 61, and 62, which were shown originally in FIG. 8. At that point the dimension of the outer diameters of sequential rollers ceases to increase and rollers 34 of constant maximum outer diameter continue along the rotating shaft 35 within the Zone C where the final cooling of the pipe occurs. It will be noted that FIG. 20 shows the inlet end of the shaft 35 being supported by a bearing block 63 which is attached to a portion of the machine frame 64.

FIG. 21 is a simplified schematic representation similar to that of FIG. 20, but in plan view like FIG. 10, where the pipe 42 is shown expanding very rapidly to the maximum circumference 42E before reaching the first pair of matched outlet rollers 32 and 34 which have been laterally displaced by the opposing pairs of adjusting means which include pillow blocks 80 and 81. The rollers 32 and 34 all have the same diameter. This figure illustrates that the supporting bearings for the shafts 33 and 35 are in the pillow blocks 80 and 82 which are mounted upon the lateral deflection devices 65 at each of the two locations shown. It will be noted that the point of maximum lateral deflection for the shafts 33 and 35 is at a point of maximum circumference 42E just as the hot pipe is discharged from the induction heater coil 22. The shafts 33 and 35 are bowed with a decreasing deflection so that the size and shape of the nesting grooves decreases as the amount of expansion of the pipe decreases longitudinally. In this figure it will be noted that the lateral deflection devices are not located after every second roller, as was shown in FIG. 10, but that they are located at an interval of five rollers.

Figure 22:
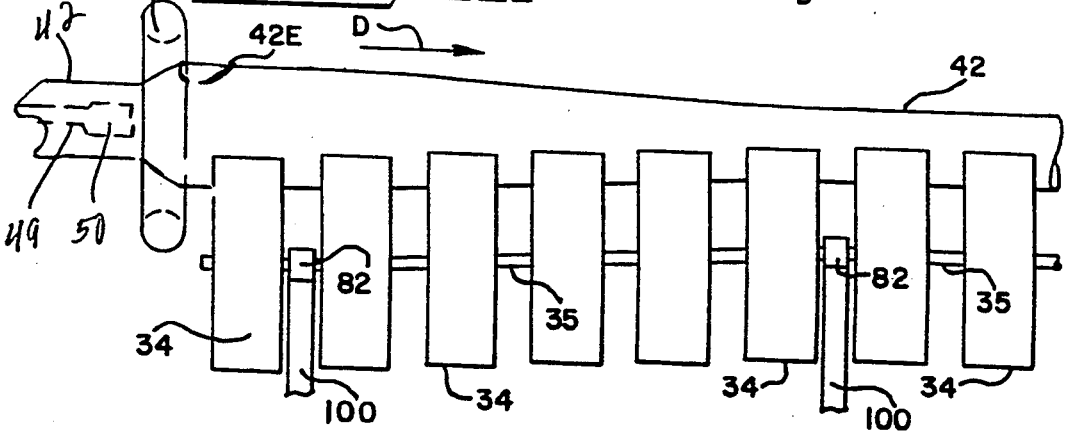
FIG. 22 is a simplified schematic left side elevational view, similar to that of FIG. 12, showing the outlet portion of the apparatus with a thermally expanded pipe or tube rotating within the nesting grooves between rotating paired outlet rollers, but showing the rotatable shaft for the outlet rollers deflected downwardly in order to compensate for the thermal contraction of the rotating pipe or tube within the nesting grooves.

FIG. 22 shows a simplified schematic left side elevational view, which is similar to FIG. 12, except that the expansion of the pipe 42 to the maximum circumference 42E is shown occurring with such rapidity that no section of axial bowing occurs where the bow has an increasing deflection as shown in FIG. 12. The hot pipe first mounts the paired matching outlet rollers 34 and 32 (32 is not shown) which are at the point of maximum deflection adjacent the point of maximum pipe circumference 42E. Thereafter, the amount of shaft bowing decreases progressively so that the sequence of nesting grooves becomes smaller in size and shape until it reaches a position of constant size after the last (the second) deflection means 82, which is mounted upon the vertical deflection device 100. The rollers 32 and 34 all have the same and a constant diameter. It will be seen in this embodiment that the two vertical deflection means 82, as well as the corresponding two deflection means 80 which are hidden behind deflection means 82, are not positioned at every second roller as was shown in FIG. 12, but that they are located at an interval of five rollers.

In order to allow for anticipated variations in pipe expansion and contraction, as well as machine slack or play, the horizontal shaft deflection apparatus 65 is designed to laterally bow the shafts 33 and 35 apart by $\frac{1}{4}$ inch, even though a typical expansion in the pipe diameter of only from about 0.200 to about 0.300 inch is experienced for carbon steel pipes having a nominal pipe size of from 2 to 15 inches. This means that each pillow block can be shifted $\frac{1}{8}$ inch from the apparatus center line. Similarly, the vertical shaft deflection apparatus 100 is designed to bow the shafts 33 and 35 vertically downward by $\frac{1}{8}$ inch from the normal shaft center line position.

In operations using carbon steel pipe having a nominal size of from 2 to 15 inches, each pair of opposed rollers 32 and 34 is about 6 inches apart from the adjacent pairs of rollers on each side in the Zone C where the slowest rate of cooling occurs. The movable pillow blocks are not positioned between each pair of rollers, or between each second pair of rollers as has been shown in FIGS. 10 and 12 for simplicity of illustration. On the contrary, the movable pillow blocks are positioned at intervals of about three feet on each of the shafts 33 and 35. Thus, the movable pillow blocks are located on the roller shafts at about every six pairs of rollers, similar to what is shown in FIGS. 21 and 22. This spacing applies whether the pillow blocks 80 and 82 are being used to deflect the rotating shafts 33 and 35 laterally or vertically downward. Generally, five sets of paired pillow blocks for deflecting shafts 33 and 35 are in the apparatus when internally coating ten foot lengths of carbon steel pipe and ten sets of paired pillow blocks are present when processing twenty foot lengths of pipe. It must be recognized that not all paired pillow blocks are necessarily activated to deflect the shafts since the amount of deflection required depends on the parameters hereinabove discussed.

Although the various aspects of the present invention have been described with preferred embodiments illustrated herein, it is to be understood that modifications and variations may be resorted to without departing from the spirit and scope of this invention. As those skilled in the art will readily understand, such modifications and variations are considered to be within the purview and the scope of the appended claims.

What is claimed is:

1. A coating apparatus for coating an inside surface of an elongated, rotating, tubular body having a longitudinal axis and a coating material inside which is to be heated and melted inside the tubular body, the apparatus comprising:

coating feed means projecting into the interior of the tubular body to discharge coating material onto the rotating interior surface of the tubular body;

a heating means for heating the tubular body and melting the coating material and causing the heated portion of the rotating tubular body to thermally expand in diameter;

an inlet side on the heating means through which the rotating tubular body passes while at a first diameter;

an outlet side of the heating means from which the rotating tubular body passes while at a larger diameter than the first diameter due to thermal expansion of the tubular body;

means for rotating the tubular body about its longitudinal axis with resultant flow of the melted coating material on the inside of the tubular body;

an axial advancing means for longitudinally advancing the tubular body through the heating means;

inlet rollers on the inlet side of the heating means for supporting the tubular body with the longitudinal axis of the portion of the tubular body thereon at a predetermined position;

upper surfaces on the inlet rollers being spaced at a first predetermined distance from the longitudinal axis;

outlet rollers on the outlet side of the heating means for supporting the tubular body to have the longitudinal axis of the expanded large diameter portion of the tubular body leaving the heating aligned with the longitudinal axis of tubular body supported on the inlet rollers;

upper surfaces on the outlet rollers spaced at different distances than the first predetermined distance from the longitudinal axis of the tubular body for the different thermally-expanded diameter section to retain the axis therethrough aligned with the longitudinal axis of tubular body supported on the inlet rollers; and roller supporting shafts carrying the outlet rollers, and adjusting means on said shafts for adjusting a sequence of nesting grooves formed between the rotating pairs of rollers along a portion of said roller-supporting shafts for the outlet rollers adjacent the outlet side of the heating means to compensate for thermal expansion and thermal contraction of a rotating elongated tubular body longitudinally advancing from said heating means into said sequential nesting grooves to keep the longitudinal axis as a straight line through the thermally expanded and thermally contracted portions of the tubular body.

2. An apparatus in accordance with claim 1 in which the means to rotate the tubular body comprises motor drive means connected to said inlet and outlet rollers to rotate these rollers and thereby to rotate the tubular member on these rollers.

3. An apparatus in accordance with claim 1 in which the roller shafts are deflected in a generally vertical direction by the means for deflecting the roller shafts.

4. An apparatus in accordance with claim 1 in which the roller shafts are deflected in a substantially horizontal direction by the means for deflecting the roller shafts.

5. An apparatus in accordance with claim 4 in which the deflecting means supports the shafts and also bows the shafts between their ends to reposition the rollers thereon.

6. An apparatus in accordance with claim 1 in which the outlet rollers vary in diameter to support different expanded diameter portions of the tubular member.

7. An apparatus in accordance with claim 6 in which the inlet rollers and the outlet rollers, at the far of the apparatus, have substantially the same diameter.

8. An apparatus in accordance with claim 7 including a plurality of shafts each carrying a plurality of outlet rollers, and in which the means for rotating the tubular body drives each of the shafts to rotate the rollers to turn the tubular body on the outlet rollers.

9. Coating apparatus for coating the inside surface of an elongated tubular body having a longitudinal axis which comprises:

a plurality of first rollers of a constant outer diameter mounted on a first rotatable shaft having an inlet end and an outlet end;

a plurality of second rollers of said constant outer diameter mounted on a second rotatable shaft having an inlet end adjacent the inlet end of said first rotatable shaft, and having an outlet end adjacent the outlet end of said first rotatable shaft, with each second roller being spaced from and adjacent to a corresponding first roller in a paired relationship to thereby define a gap of fixed dimension between paired first and second rollers;

heating means proximate the outlet ends of said first and second shafts for heating an elongated tubular body passing therethrough and causing the tubular body to thermally expand in diameter;

a plurality of third rollers mounted on a third rotatable shaft having an inlet end proximate said heating means and an outlet end spaced from said heating means;

a plurality of fourth rollers mounted on a fourth rotatable shaft having an inlet end adjacent said heating means and adjacent the inlet end of said third rotatable shaft, and having an outlet end adjacent the outlet end of said third rotatable shaft, with each fourth roller being spaced from and adjacent to a corresponding third roller of equal diameter in a paired relationship to thereby define a gap between paired third and fourth rollers;

a nesting groove above the gap between each set of paired rollers and between the adjacent portions of the upper surfaces of each set of paired rollers;

first motive means for rotating said first and second rotatable shafts and said mounted first and second rollers to thereby rotate an elongated tubular body within the nesting grooves of adjacent pairs of first and second rollers;

second motive means for rotating said third and fourth rotatable shafts and said mounted third and fourth rollers to thereby rotate an elongated tubular body within the nesting grooves of adjacent pairs of third and fourth rollers;

axial advancing means for longitudinally advancing a rotating elongated tubular body sequentially along and within the nesting grooves of adjacent pairs of first and second rollers, through said heating means, and sequentially along and within the nesting grooves of adjacent pairs of third and fourth rollers;

means for internally coating an elongated tubular body passing through said heating means; and, adjusting means on said third and fourth rotatable shafts for adjusting a sequence of nesting grooves adjacent the inlet end and along a portion of said third and fourth shafts to compensate for thermal expansion and thermal contraction of a rotating elongated tubular body longitudinally advancing from said heating means into sequential nesting grooves of adjacent pairs of third and fourth rollers to keep the longitudinal axis as a straight line through the thermally expanded and thermally contracted portions of the tubular body.

10. Coating apparatus according to claim 9 wherein said third and fourth paired rollers are replaceable rollers.

11. Coating apparatus according to claim 9 wherein said adjusting means comprises first deflection means on said third rotatable shaft proximate said inlet end thereof for bowing said third rotatable shaft laterally away from said fourth rotatable shaft, and second deflection means on said fourth rotatable shaft proximate said inlet end thereof for bowing said fourth rotatable shaft laterally away from said third rotatable shaft.

12. Coating apparatus according to claim 11 wherein said first and second deflection means are positioned on said third and fourth shafts adjacent to each other and spaced apart as a matching pair.

13. Coating apparatus according to claim 9 wherein said internal coating means comprises applicator means applying particulate coating material to the inside surface of said rotating elongated tubular body passing through said heating means.

14. Coating apparatus according to claim 9 wherein said heating means comprises an induction heater.

15. Coating apparatus according to claim 9 wherein said first and second motive means rotate said first, second, third and fourth shafts in a manner sufficient to provide that a rotating elongated tubular body leaving the nesting grooves of said first and second rollers continues to rotate at the same speed and in the same direction as it enters the nesting grooves of said third and fourth rollers.

16. Apparatus for receiving a heated cylindrical body having a longitudinal axis from a heating means which comprises:

heating means for heating a cylindrical body passing therethrough;

a plurality of first rollers mounted on a first rotatable shaft having an inlet end proximate said heating means and an outlet end spaced from said heating means;

a plurality of second rollers mounted on a second rotatable shaft having an inlet end adjacent said heating means and adjacent the inlet end of said first rotatable shaft, and having an outlet end adjacent the outlet end of said first rotatable shaft, with each second roller being spaced from and adjacent to a corresponding first roller or equal diameter in a paired relationship to thereby define a gap between paired first and second rollers;

a nesting groove above the gap between each set of paired rollers and between the adjacent portion of the upper surfaces of each set of paired rollers;

motive means for rotating said first and second rotatable shafts and said mounted first and second rollers to thereby rotate a cylindrical body within the nesting grooves of adjacent pairs of first and second rollers;

axial advancing means for longitudinally advancing a rotating cylindrical body through said heating means and sequentially along and within the nesting grooves of adjacent pairs of first and second rollers; and, adjusting means on said first and second rotatable shafts for adjusting a sequence of nesting grooves adjacent the inlet end and along a portion of said first and second shafts to compensate for thermal expansion and thermal contraction of a rotating cylindrical body longitudinally advancing from said heating means into sequential nesting grooves of adjacent pairs of first and second rollers to keep the longitudinal axis as a straight line through the thermally expanded and thermally contracted portions of the tubular body.

17. Apparatus according to claim 16 wherein said first and second paired rollers are replaceable rollers.

18. Apparatus according to claim 16 wherein said adjusting means comprises first deflection means on said first rotatable shaft proximate said inlet end thereof for bowing said first rotatable shaft laterally away from said second rotatable shaft.

19. Apparatus according to claim 16 wherein said heating means comprises an induction heater.

20. Apparatus according to claim 19 wherein said rotating cylindrical body is an elongated tubular body and said apparatus further includes internal coating means applying particulate coating material to the inside surface of said rotating elongated tubular body passing through said heating means.

* * * * *